United States Patent [19]

Ishikawa et al.

[11] 4,151,061

[45] Apr. 24, 1979

[54] ALUMINUM ELECTROLYTIC CELL

[75] Inventors: Tatsuo Ishikawa; Shoichi Konda, both of Sapporo; Toshiaki Iuchi, Shizuoka; Hachiro Ichikawa, Shimizu, all of Japan

[73] Assignee: Nippon Light Metal Company Limited, Tokyo, Japan

[21] Appl. No.: 851,631

[22] Filed: Nov. 15, 1977

[51] Int. Cl.[2] ..... C25C 3/06; C25C 3/14

[52] U.S. Cl. ..... 204/247; 204/67

[58] Field of Search ..... 204/67, 243 R, 244, 204/245-247

[56] References Cited

U.S. PATENT DOCUMENTS

| | | | |
|---|---|---|---|
| 1,545,383 | 7/1925 | Ashcroft | 204/247 X |
| 3,785,941 | 1/1974 | Jacobs | 204/247 X |
| 3,893,899 | 7/1975 | Dell et al. | 204/247 X |
| 3,909,375 | 9/1975 | Holliday et al. | 204/67 X |

*Primary Examiner*—John H. Mack
*Assistant Examiner*—D. R. Valentine
*Attorney, Agent, or Firm*—William J. Daniel

[57] ABSTRACT

An aluminum electrolytic cell wherein, in a sealed type electrolytic cell having a raw material aluminum chloride feeding port and chlorine gas discharging ports in a top section and a molten metal reservoir in a bottom section and provided with an electrode element in the intermediate section so that a molten salt electrolytic bath containing aluminum chloride is electrolyzed in the cell and molten aluminum is collected from the metal reservoir in the bottom section, the electrode element is formed of funnel-shaped electrodes laminated at a fixed distance between the electrodes or a pair of right and left electrode plate groups opposed to each other at a fixed separation between them and inclined to be lower inward at least one intermediate bi-polar electrode is provided between both cathode and anode and a gas rising passage is formed between the outer edges of the funnel-shaped electrodes or the electrode plates and inner wall of the cell to prevent the rechlorination of the aluminum after electrolysis.

9 Claims, 5 Drawing Figures

ALUMINUM ELECTROLYTIC CELL

BACKGROUND OF THE INVENTION

1. Field of the Invention

The present invention relates to electrolytic cells for obtaining aluminum from aluminum chloride by electrolyzing a molten salt electrolytic bath containing molten aluminum chloride.

2. Description of the Prior Art

An aluminum chloride electrolyzing method wherein aluminum is obtained by electrolyzing a molten salt electrolytic bath containing molten aluminum chloride for example, an electrolytic bath of $AlCl_3$—NaCl—LiCl system or $AlCl_3$—$MgCl_2$—NaCl system, at a temperature above the melting point of aluminum has various advantages. Thus it can be operated at an electrolyzing temperature near the temperature of 700° C. which is about 300° C. lower than in the Hall Heroult process and that, as the anode reaction product by the electrolysis is a chlorine gas, no reaction with graphite used as an electrode material will take place and therefore the electrode will not be worn. This way of electrolytically producing aluminum therefore holds the possibility of saving energy and resources but is not yet established as an industrial process.

However, the most promising embodiment of this technique up to now is an electrolytic cell using horizontal bi-polar electrodes manufactured recently by ALCOA, U.S.A. (U.S. Pat. No. 3,822,195).

An important feature of this electrolytic cell of ALCOA is the provision of many horizontal rectangular graphite electrode plates between both electrodes of an electrolytic cell filled with a halide molten salt containing aluminum chloride so as to produce a proper clearance from the inner wall of the cell. In operation the aluminum chloride in the bath between the respective laminated electrodes is electrolyzed by passing an electric current between both electrodes so as to produce a chlorine gas between the anodes of the respective electrodes and molten aluminum grains on the cathode surfaces, so that the chlorine gas produced at the anodes is made to rise through the air gap formed between the electrodes and the inner wall of the cell as a rising passage from one side of the rectangular electrodes. The rising gas flow produces a unidirectional circulating current in the electrolytic bath while on the other hand, the molten aluminum grains produced at the cathodes decend on the cathode surfaces countercurrently against the circulating current through the gas rising passage under their own weight and are accumulated in the bottom of the cell.

However, in the ALCOA electrolytic cell, as described, it has been observed that, as the chlorine gas and molten aluminum move countercurrently through the same gas rising passage and the chlorine gas produced at the anodes concentrates on one side of the rectangle, the gas content in the electrolytic bath between the electrodes on the discharging side will be large and the chances of the aluminum and chlorine gas contacting each other will be so high that the aluminum tends to become re-chlorinated and the overall efficiency of the cell reduced.

SUMMARY OF THE INVENTION

An object of the present invention is to provide an electrolytic cell wherein the defects of the above mentioned conventional electrolytic cell are eliminated and an efficient electrolysis of aluminum chloride can be made.

The aluminum electrolytic cell for electrolyzing aluminum chloride according to the present invention has a raw material aluminum chloride feeding port and chlorine gas discharging ports in its top section and a molten metal reservoir in its bottom section and is provided with an electrode part in the intermediate element so that a molten salt electrolytic bath containing aluminum chloride is electrolyzed in the cell, and the electrode element is formed of at least three vertically stacked electrodes inclined downwardly, and inwardly, having a first communicating passage in the center and a second communicating passage formed between the outer edge of the electrode and the inner wall of the cell and the electrode element comprises a cathode, an anode and at least one bi-polar electrode situated between the cathode and anode.

DETAILED DESCRIPTION OF PREFERRED EMBODIMENTS

Figure 1A:
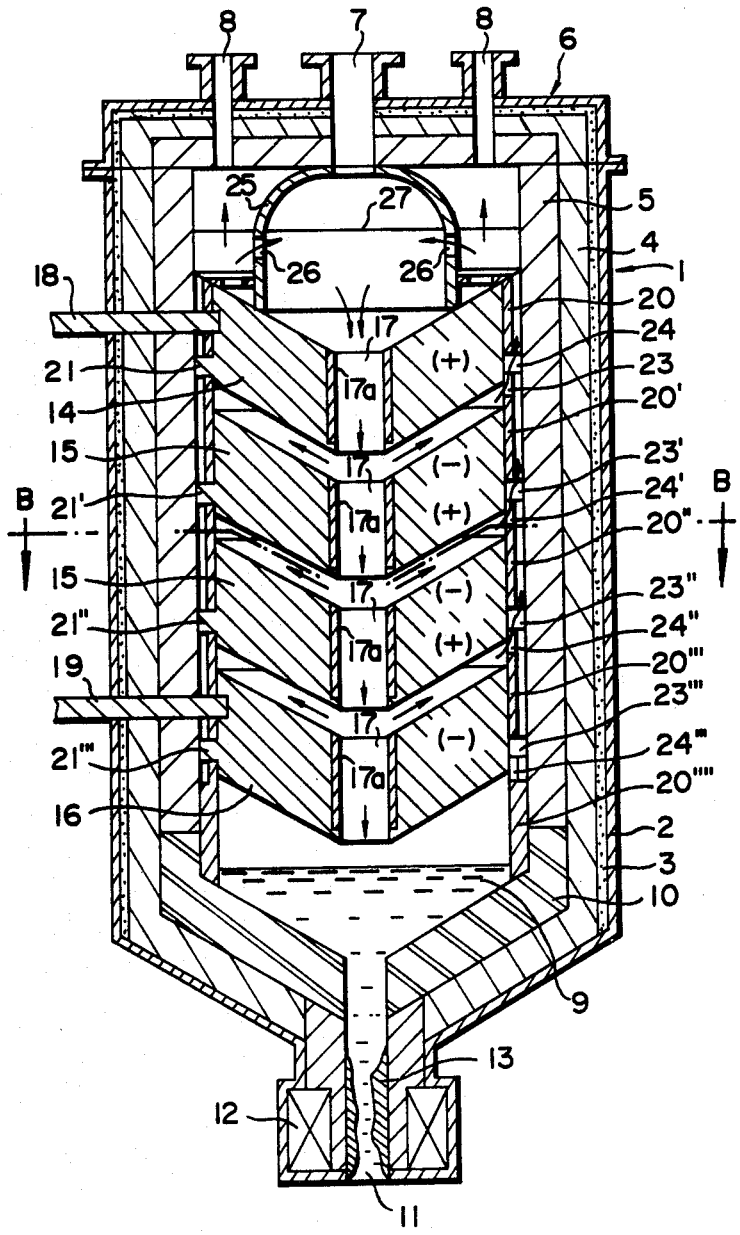
FIG. 1A is a vertical sectional view of an embodiment of an electrolytic cell according to the present invention.
Figure 1B:
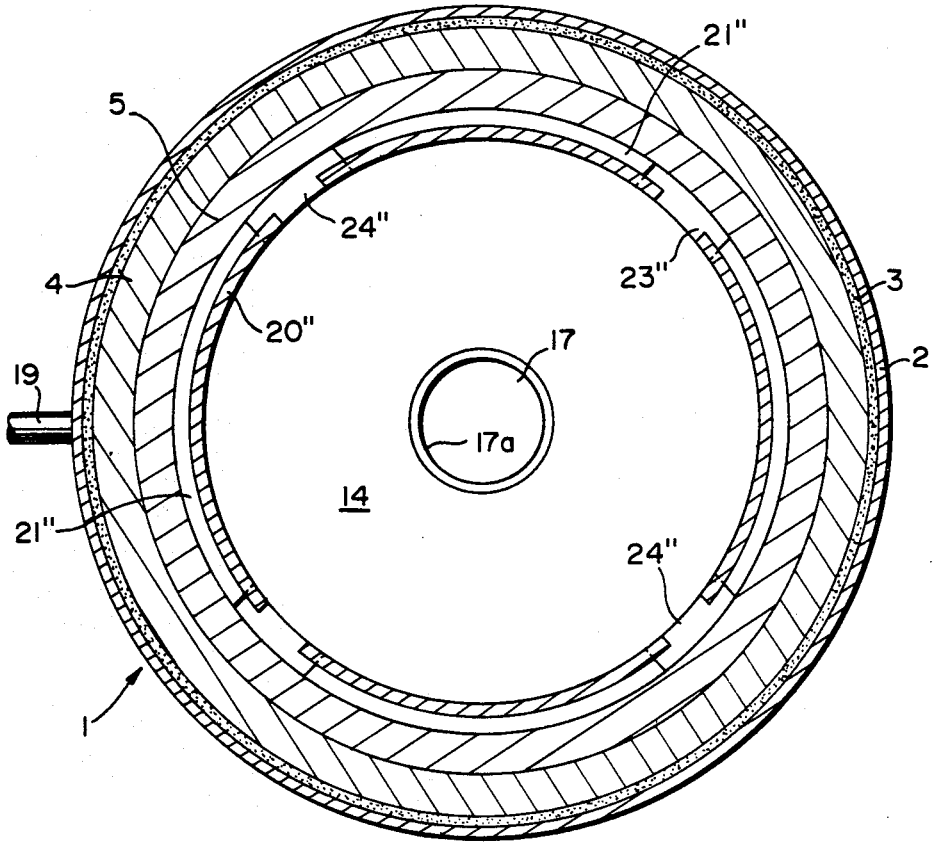
FIG. 1B is a sectional view on line B—B in FIG. 1A.
Figure 2:
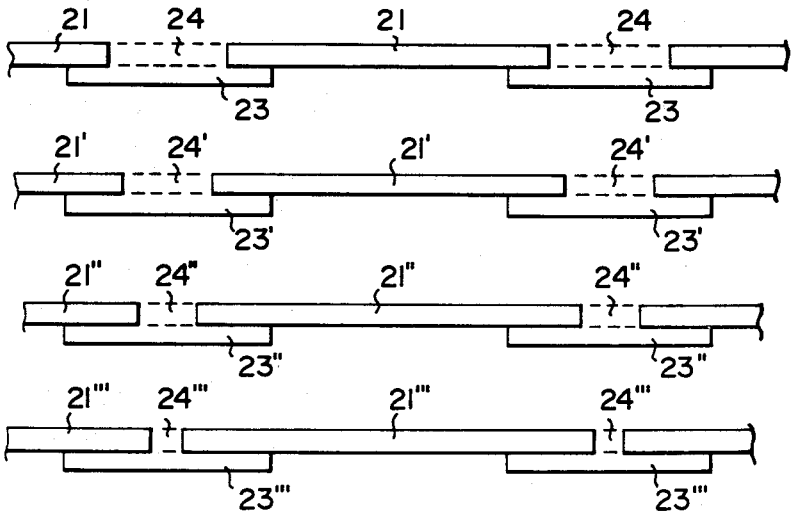
FIG. 2 is a developed view of flange parts and sleeves of the respective electrodes in the embodiment in FIG. 1.

In the embodiment in FIGS. 1A, 1B and 2, numeral 1 indicates a cylindrical sealed type electrolytic cell formed of, in order an outer plate 2 made of iron, an insulating glasswool layer 3, a refractory aluminum material 4 and a refractory nitride material 5. Numeral 6 indicates a sealing lid for the top of the electrolytic cell 1 and completely a sealed type electrolytic cell. A raw material feeding port 7 for introducing as raw material aluminum chloride vapor is provided in the center of the lid 6. A plurality of gas discharging ports 8 for discharging chlorine gas generated by an electrolysis out of the cell are provided adjacent the periphery of the lid 6.

A reservoir 9 for molten aluminum obtained by the electrolysis is formed in the bottom section of the electrolytic cell 1 and bricks made of graphite are used for the inner wall 10 of this section. Numeral 11 indicates an outlet port for collecting molten aluminum accumulated in the molten aluminum reservoir 9. A temperature regulating mechanism 12 is provided on the periphery of outlet port 11 so that, by properly controlling the temperature of the inner wall of the outlet port 11, the thickness of the solidified metal layer 13 deposited on the inner wall can be adjusted and the metal discharge velocity can be thereby adjusted. 14, 15, 15 and 16 are funnel-shaped electrodes made of graphite, having center holes 17 and peripheral clearances from inner wall 10 and concavely inclining toward the center holes 17. The respective electrodes 14, 15, 15 and 16 are arranged in vertically stacked relation with a proper distance between them with the vertical center coaxially with axis of the electrolytic cell 1 and the uppermost electrode 14 and lowermost electrode 16 are connected respectively with current passing terminals 18 and 19 so as to respectively form an anode and cathode. An internal sleeve 17*a* made of a refractory material such as of alumina or nitride having a resistance to attach by the bath is fitted in each center hole 17 as a sealing material. The electrodes 15 located intermediately between the anode and the cathode electrodes 14 and 16 each act as a bi-polar electrode fuctioning as both types electrodes on its upper and lower surfaces, respectively (as indicated by the polarity symbols in FIG. 1A). 20, 20', 20'', 20''' and 20'''' are external sleeves made of bath resistant refractory material such as alumina or nitride for coating and protecting the outside surfaces of the electrodes 14, 15, 15 and 16 and holding the respective electrodes 14, 15, 15 and 16 at a fixed clearance between them. The respective electrodes 14, 15, 15 and 16 are supported by the above mentioned sleeves 20, 20', 20'', 20''' and 20'''' on flange parts 21, 21', 21'' and 21''' provided respectively on the sleeve peripheries adjacent their the lower ends. Further, the above mentioned respective sleeves and flanges are provided respectively with slots 23, 23', 23'' and 23''' and 24, 24', 24'', 24''' communicating at proper intervals. By the way, as seen in the developed view shown in FIG. 2, the slots 24, 24', 24'' and 24''' formed respectively in the above mentioned flange parts 21, 21' 22'' and 21''' preferably gradually increase in size toward the upper part of the cell in which the amount of the gas is larger. 25 is a hood made of bath resistant refractory material such as alumina or nitride, connecting the center hole 17 of the upper most funnel-shaped electrode 14 with the above mentioned raw material feeding port 7 and having on the lower peripheral surface a plurality of passages 26 through which the electrolytic bath flows in. The hood 25 may be made by cylindrically stacking firebricks or the like.

The operation of the electrolytic cell formed as in this embodiment shall be described in the following.

When the cell 1 is first filled to the bath level 27 with a halide electrolytic bath containing aluminum chloride and an electric current is passed beteween electrodes 14 and 16, the respective funnel-shaped electrodes 15 present as held between the electrodes 14 and 16 will become bi-polar electrodes and their upper surfaces and lower surfaces will function respectively as cathodes and anodes.

Therefore, by the electrolysis of aluminum chloride in the electrolytic bath present in the spaces between the respective electrodes 14, 15, 15 and 16, chlorine gas will be produced on the anode surfaces and molten aluminum will be deposited in the form of grains on the cathode surfaces. Now, since the respective electrodes 14, 15, 15 and 16 are funnel shaped, the molten aluminum grains produced on the cathode surfaces will descend centripetally toward the center holes 17 along the sloping upper surfaces of the funnels and will fall into the center holes 17 to be accumulated in the molten metal reservoir 9. On the other hand, on the anodes, the produced chlorine gas will diffusely rise in a radial direction along the sloped lower surfaces of the funnels, passing through the peripheral clearances (gas rising passages) through the slots 23, 23', 23'' and 23''' of the sleeves and the slots 24, 24', 24'' and 24''' of the flanges and will be discharged out of the cell through the gas discharging ports 8 provided in the peripheral part of the lid part 6 in the cell top part.

In such case, the electrolytic bath contained in the above mentioned gas rising passages will develop rising flow current due to the buoyant effect of the chlorine gas. On the contrary, a falling flow current will be produced in the center hole 17 of the electrode. Thus, as shown by the arrows in FIG. 1, the electrolytic bath will form a circulating flow current which passes between the respective electrodes 14, 15, 15 and 16 from the center hole 17, until the peripheral part of the cell is reached, then rises through the peripheral clearances (gas rising passages), to become separated from the chlorine gas in the uppermost section of the cell and then will return to the center hole 17 again from the passages 26 in the hood 25.

Incidentally, in the case of laminating a plurality of funnel-shaped electrodes 14, 15, 15 and 16 at a fixed distance between them, the electrodes having flanges which are also supporters are used in the drawing but, for example, the electrodes may be held by setting separators of stays by a plurality of fine alumina pipes. It is needless to say that, in such case, a proper gas rising passage will have to be provided between the electrodes and the inner wall of the cell. Also, the electrodes may be held only by cylindrical sleeves which may be made to communicate with the peripheral clearances (gas rising passages) by providing slots.

In the embodiment of FIGS. 1A, 1B and 2, the raw material feeding port 7 and the center hole 17 of the electrode are in communication with each other through the hood 25 but the raw material aluminum chloride vapor can be blown directly into the center hole of the electrode from the raw material feeding port without using the hood if desired.

Figure 3:
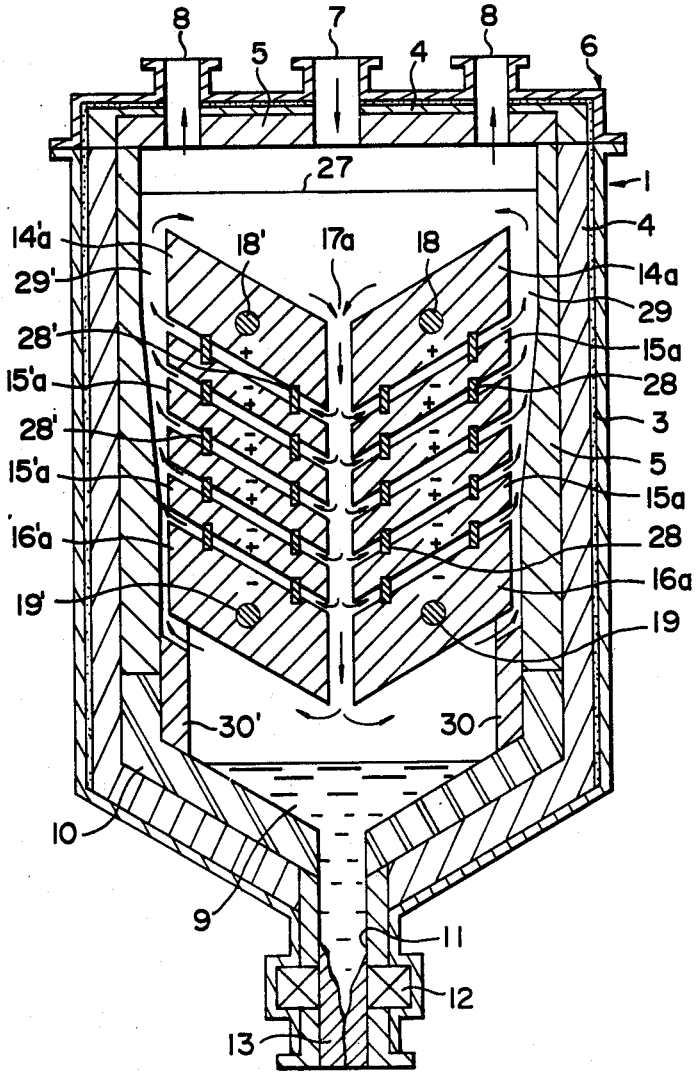
FIG. 3 is a vertically sectional view of another embodiment of the electrolytic cell according to the present invention.
Figure 4:
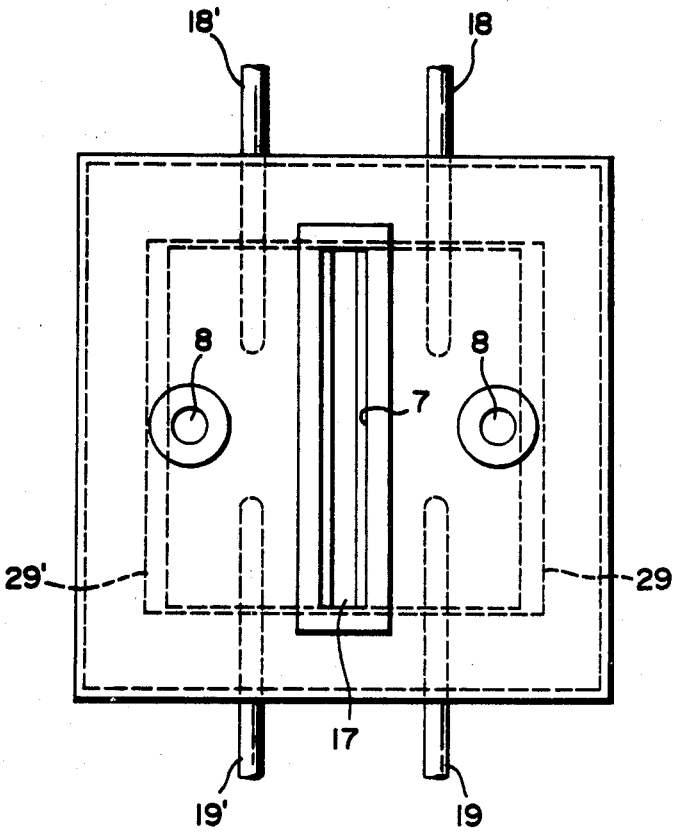
FIG. 4 is a plan view of the embodiment in FIG. 3.

The embodiment in FIGS. 3 and 4 shall be described in the following. In this embodiment, the same reference numerals but with alphabetical sub-designations are attached to the same respective parts as in FIGS. 1 and 2.

The primary difference between this embodiment and the above described embodiment is that pairs of right and left inclined electrode plate groups are provided instead of the funnel-shaped electrodes made of graphite and used in the above described embodiment. That is to say, 14*a*, 15*a*,—15*a*, 16*a* and 14'*a*, 15'*a*,—15'*a*, 16'*a* are pairs of right and left inclined electrode plate groups provided in opposed relation to each other on the right and left. 14*a* and 14'*a* act as anodes while 16*a* and 16'*a* act as cathodes. 15*a*, 15*a*—15'*a*, 15'*a*— (formed respectively by four pairs of plates in the drawing) are bi-polar electrodes situated between the anodes and cathodes 14*a*, 16*a* and 14'*a*, 16'*a*. The upper surfaces of the bi-polar electrodes function as cathodes and their lower surfaces function as anodes.

Adjacent pairs of electrode plates are kept at a fixed distance between them respectively by spacers 28, 28,—28', 28'—, the anodes 14*a* and 14'*a* and cathodes 16*a* and 16'*a* are held in an outer casing respectively by conductive rods 18, 18' and 19, 19' and the conductive rods 19 and 19' are positively supported by refractory materials 30. These right and left electrode plate groups are provided in opposed relation to each other with a fixed clearance between their inner edges. Thus a falling passage 17*a* for the electrolytic bath and molten metal is defined by this clearance. Further, rising passages 29 and 29' for the electrolytic bath and chlorine gas are formed between the outer ends of the respective electrode plate groups 14*a*, 15*a*,—15*a*. 16*a* and 14'*a*, 15'*a*-,—15'*a*, 16'*a* and the inner wall (refractory material layer 5) of the electrolytic cell. By the way, it is preferable that the above mentioned rising passages 29 and 29' are made wider in the direction of the upper section of the cell in which the amount of the gas is larger.

Now, the operation of the electrolytic bath of this embodiment is substantially the same as of the above described embodiment. When the cell is first filled to the bath level 27 with a halide electrolytic bath containing aluminum chloride and an electric current is passed between both electrodes 14*a*, 16*a* and 14'*a*, 16'*a* of the right and left electrode plate groups, the respective intermediate electrode plates 15*a* and 15'*a* will operate as bi-polar electrodes in which their upper surfaces will function as cathodes and their lower surfaces will function as anodes. The aluminum chloride in the electrolytic bath present in the spaces between the respective electrodes 14*a*, 15*a*,—15*a*, 16*a* and between the respective electrodes 14*a'*, 15*a'*,—15*a'*, 16' will be electrolyzed, a chlorine gas will be produced on the anode surfaces and molten aluminum will be deposited in the form of grains on the cathode surfaces. Since the respective electrode plates 14*a*, 15*a*,—15*a*, 16*a* and 14*a'*, 15*a'*,—15*a'*, 16*a'* slant downwardly inwardly, the molten aluminum grains produced on the cathode surfaces will descend due to their own weight inwardly of the cell along the sloped upper surfaces of the electrode plates, to eventually fall into the passage 17*a* formed in the clearance between both electrode plate groups and be accumulated in the molten metal reservoir 9.

On the other hand, the chlorine gas produced on the anode surfaces will rise outwardly of the cell along the sloped lower surfaces of the respective electrode plates, through the rising passages 29 and 29' formed of the clearances between the outer ends of the electrode plates and the inner wall of the cell and will be discharged out of the cell through the gas discharging ports 8 provided in the lid part in the top part of the cell.

In such case, the electrolytic bath contained in the above mentioned rising passages 29 and 29' will be subjected to the buoyancy effect of the rising chlorine gas and will develop a rising flow current. On the other hand, a falling flow current will be produced in the falling passage 17*a* formed between the right and left electrode plate groups and, therefore, as indicated by the arrows in FIG. 3, the electrolytic bath in the cell will form a circulating flow current which will go outward in the cell through between the respective electrode plates 14*a*, 15*a*,—15*a*, 16, 14'*a*, 15'*a*,—15'*a* 16'*a*, rise through the gas rising passages 29 and 29' until reaching the upper part of the cell, and will return again to the falling passage 17*a* between the respective electrode plate groups.

As explained above, according to the present invention, as the electrode element activated in the intermediate section of the electrolytic cell is arranged at an inclination so as to be lower at their inward ends, the chlorine gas produced on the anode surfaces of the electrodes will quickly rise along the sloping lower surfaces of the electrode plates while, on the other hand, the molten aluminum grains deposited on the cathode surfaces of the electrodes will quickly descend due to their own weight along the sloping upper surfaces of the electrode plates and therefore the risks of the aluminum being re-chlorinated will be remarkably small. Further, as the chlorine gas rising passage and the molten metal falling passage are independent and separate of each other, the chances of the aluminum and chlorine gas contacting each other in these regions will be also small and therefore it will be possible to substantially perfectly prevent loss of efficiency by re-oxidation.

By the way, from the viewpoint of the structure and the current efficiency in the case of the electrolysis, it is proper that the angle of inclination of the inclined electrode plates used in the embodiment of the present invention range from about 10 to 50 degrees.

Further, the present invention is not limited to the above mentioned embodiments. For example, for an electrolytic cell a large capacity, the above mentioned pair of electrode plate groups may be made as a set and a plurality of such sets may be arranged in parallel.

We claim:

1. A sealed electrolytic cell for electrolyzing a molten salt electrolytic bath containing aluminum chloride to produce molten aluminum metal which comprises a cell housing an electrical element in said housing comprising an array of at least three electrode plates inclined downwardly and inwardly towards the housing center in fixed generally parallel spaced apart relation, substantially centrally located apertures in all such plates in generally vertical alignment to define a common passageway extending vertically through said electrode array and outer passages defined between the outer side edges of said electrode plates and the inner wall of said cell housing, one outer electrode plate acting as a cathode, the other outer plate acting as an anode and each intermediate plate acting as a bi-polar electrode, raw material inlet means at the top of said housing for introducing aluminum chloride into the electrolyte bath above and in substantial alignment with the central common passageway in said electrode plate array, chlorine gas discharging means at the top of said housing, and an aluminum metal collecting reservoir at the bottom of said housing below said electrode element.

2. The aluminum electrolytic cell according to claim 1 wherein said electrode plates are funnel-shaped and a hole is made in the center thereof to form said central aperture.

3. The aluminum electrolytic cell according to claim 1 wherein each said electrode plate is formed by a pair of rightwardly and leftwardly inclined electrode plates, the inside edges of each such pair being spaced apart a fixed distance to form said central aperture.

4. The aluminum electrolytic cell according to claim 1 wherein a hood is disposed between said raw material feeding means and the uppermost electrode plate, said hood extending at its lower margins into said electrolyte bath and having passages for the electrolytic bath in said margins.

5. The aluminum electrolytic cell according to claim 1 wherein said outer passages are made generally wider in the direction of the top of the cell housing.

6. The aluminum electrolytic cell according to claim 3 wherein the angle of inclination of said inclined electrode plates is 10 to 50 degrees from the horizontal.

7. The aluminum electrolytic cell according to claim 2 wherein said funnel-shaped electrode plates are maintained with a fixed spacing between them by a plurality of flanges provided at the outer peripheries thereof and cooperating sleeves fitted to the inner wall of the cell housing for supporting the flanges.

8. The aluminum electrolytic cell according to claim 3 wherein said electrode plates are held with a fixed spacing by spacers.

9. A sealed electrolytic cell including a housing having a top cover provided generally at the center thereof with a raw material feeding port and adjacent its periphery with at least one gas discharging port, and a bottom wall defining a molten metal reservoir and a metal outlet port, and with said housing a plurality of funnel-shaped electrode plates having generally centrally located holes therein in alignment with said feeding port, said electrode plates being stacked with fixed clearance so as to form at least one intermediate bi-polar electrode between a cathode and an anode plate, and means defining an adequate gas rising passage formed between the outer peripheral side edge of each of the electrode plates and the inner wall of the housing, said raw material feeding port being connected to the center hole of the uppermost funnel-shaped electrode through a hood.

* * * * *